US009551148B2

(12) United States Patent
Pilz

(10) Patent No.: US 9,551,148 B2
(45) Date of Patent: Jan. 24, 2017

(54) HEADER TRACK WITH STUD RETENTION FEATURE

(71) Applicant: CALIFORNIA EXPANDED METAL PRODUCTS COMPANY, City of Industry, CA (US)

(72) Inventor: Donald A. Pilz, Livermore, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 0 days.

(21) Appl. No.: 15/007,037

(22) Filed: Jan. 26, 2016

(65) Prior Publication Data

US 2016/0215494 A1 Jul. 28, 2016

Related U.S. Application Data

(60) Provisional application No. 62/108,249, filed on Jan. 27, 2015, provisional application No. 62/191,934, filed on Jul. 13, 2015.

(51) Int. Cl.

| | |
|---|---|
| ***E04B 2/76*** | (2006.01) |
| ***E04C 2/20*** | (2006.01) |
| ***E04B 2/02*** | (2006.01) |
| ***E04B 2/78*** | (2006.01) |
| *E04B 2/74* | (2006.01) |

(52) U.S. Cl.

CPC ..... *E04C 2/205* (2013.01); *E04B 2/02* (2013.01); *E04B 2/7457* (2013.01); *E04B 2/767* (2013.01); *E04B 2/789* (2013.01); *E04B 2/7411* (2013.01); *E04B 2002/0289* (2013.01)

(58) Field of Classification Search

CPC ..... E04B 2/7457; E04B 2/767; E04B 2/7411; E04B 2/789; E04C 2003/0473

USPC ..... 52/241

See application file for complete search history.

(56) References Cited

U.S. PATENT DOCUMENTS

| | | | | |
|---|---|---|---|---|
| 2,105,771 | A * | 1/1938 | Holdsworth | E04B 2/825 52/241 |
| 4,805,364 | A * | 2/1989 | Smolik | E04B 2/7457 52/241 |
| 5,797,233 | A * | 8/1998 | Hascall | E04B 2/766 52/481.1 |
| 7,810,295 | B2 * | 10/2010 | Thompson | E04H 9/14 248/208 |
| 2007/0130873 | A1 * | 6/2007 | Fisher | E04B 2/18 52/596 |
| 2012/0247038 | A1 * | 10/2012 | Black | E04C 2/384 52/220.1 |
| 2015/0275510 | A1 * | 10/2015 | Klein | E04B 1/948 52/232 |

* cited by examiner

*Primary Examiner* — Rodney Mintz
*Assistant Examiner* — Daniel Kenny
(74) *Attorney, Agent, or Firm* — Knobbe, Martens, Olson & Bear LLP

(57) ABSTRACT

A track for a wall construction for use in building construction is disclosed. Embodiments can include a track having a plurality of bendable tabs that can be manipulated to grip or release wall studs to prevent lateral or side to side movement of the studs. Embodiments can include tracks which incorporate various geometries capable of receiving fire-retardant material, including but not limited to intumescent material.

13 Claims, 7 Drawing Sheets

HEADER TRACK WITH STUD RETENTION FEATURE

INCORPORATION BY REFERENCE TO ANY PRIORITY APPLICATIONS

Any and all applications for which a foreign or domestic priority claim is identified in the Application Data Sheet as filed with the present application are hereby incorporated by reference herein.

BACKGROUND OF THE INVENTION

Field of the Invention

The present invention generally relates to a metal stud and track framing system for use in building constructions, particularly for use in the interior and/or exterior wall of a building. In particular, the present invention relates to a fire-rated and non-fire rated track having a stud retention feature.

Description of the Related Art

A wall assembly commonly used in the construction industry includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher level floor of a multi-level building.

Header tracks generally have a web and at least one flange extending from the web. Typically, the header track includes a pair of flanges, which extend in the same direction from opposing edges of the web. The header track can be a slotted header track, which includes a plurality of slots spaced along the length of the track and extending in a vertical direction. When the wall studs are placed into the slotted track, each of the plurality of slots accommodates a fastener used to connect the wall stud to the slotted track. The slots allow the wall studs to move generally orthogonally relative to the track. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads, as described above.

Slotted track has become a staple product for providing vertical deflection movement across the U.S. within head-of-wall assemblies. The slots are generally ¼ inch by 1-½ inch spaced 1 inch on center vertically along the length of the track leg. These slots have become a source for sound flanking as unsealed slots at the head-of-wall joint will allow sound, smoke, or light to pass from one side of the wall to the other through the unsealed slot. During installation, extra labor is required as mechanical framing screws are used through the slotted track into the stud on both sides of the wall. When the drywall is installed over this framing attachment point, the drywall humps up around the framing screw causing the drywall to flare out away from the framing. When the drywall flares out away from the framing, it no longer maintains a tight seal to the framing and can provide smoke or sound flanking paths through and or around the slots. This flared out drywall around the framing screw also creates an uneven wall surface and requires extra joint compound to create the illusion of an even wall surface.

It is also desirable or even mandatory to provide fire block arrangements at one or more linear wall gaps, which may be present between the top, bottom or sides of a wall and the adjacent structure. The fire block arrangements often involve the time-consuming process of inserting by hand a fire resistant material into the wall gap and then applying a flexible sealing layer to hold the fire resistant material in place. More recently, heat-expandable intumescent fire block materials have been integrated into the top or bottom track of the stud wall assembly.

SUMMARY OF THE INVENTION

Several preferred embodiments of a track having a plurality of bendable tabs are described herein, typically in the context of a wall assembly. One aspect of a track disclosed herein provides a way to secure metal studs to the header track and/or bottom track without driving traditional mechanical framing screws through the leg of the track into the vertically placed studs. In one embodiment, a C-shaped tab track receives the vertically placed metal studs and has a series of, for example, 1/16 inch wide slits spaced apart, for example, approximately every ⅝ to 1-½ inch on center, starting at the open end of the track legs and going vertically up the leg toward the web. The 1/16 inch wide slits run, for example, about ½ inch to 1-inch up the leg of the track within the inward bent portion or straight part of the leg of the tab track. The tab track can be made from light gauge sheet steel and can be manufactured with standard roll form tooling or on a brake press, for example.

Once the studs are nested into the header track, the pre-bent vertical legs with slits provide a series of tabs that allow numerous locations to lock or secure the vertical studs in place and prevent lateral side to side movement of the studs along the length of the stud wall/header track/footer track. The stud can be installed by inserting the stud at about 90 degrees from its normal position and then rotating the stud into place, thereby outwardly deflecting the tab or tabs aligned with the stud. The tabs adjacent the stud remain inwardly bent to secure the stud in place. To move the stud to a different location, the installer can rotate the stud a half turn which will free up the stud out of the restrictions of the tabs.

Metal stud framing in today's construction industry is more precise than ever because the wall framing has to share space with more mechanical, electrical, plumbing and data (MEP's) than ever before. In many cases the stud layout gets the lowest priority of importance over the placement of MEP's. For this reason, a stud must be able to have the flexibility to go anywhere necessary to get around the MEP's.

In the past, metal stud wall framing assemblies that provided set attachment points at 8 inch or 4 inch on center in hopes to provide attachment points for all studs have not been successful because studs, although they cannot exceed the maximum allowable spacing of 16 inch or 24 inch, many times will be less than the maximum spacing in order to work around MEP's.

For these reason it would be of great value to create a manufactured framing system that provides, in some configurations, the required vertical deflection movement, allows the studs to be placed anywhere within the wall, connects the stud to the track to prevent side to side or lateral movement along the wall length, is made from a solid track in at least an upper portion of the side flange that did not allow smoke, sound or light to travel through the wall, and does not require the extra labor or the cost for additional framing screws or crimping devises at each side of the stud at both top and bottom.

In one aspect, a track for a fire-rated or non-fire rated wall assembly for a linear wall gap is disclosed. The track includes a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section, each of the first and second flanges has a free end opposite a respective one of the first side edge and second side edge, each of the first and second flanges has a plurality of slits, each of the slits having a first end adjacent to the free ends of the first and second flanges and a second end opposite the first end, the plurality of slits defining a plurality of tabs in which each adjacent pair of the plurality of slits forms a tab therebetween.

In some aspects, a length of each of the slits is 1 inch, a width of each of the slits is ⅛ inch, and the tabs are spaced apart 1-¼ inch on center along the length of track. In some aspects, the tabs extend one-third of the length of the first and second flanges as measured from the free ends of the first and second flanges. In some aspects, prior to use, the tabs are aligned with the first and second flanges. In some aspects, the tabs are bendable from a bent to an unbent configuration and from an unbent to a bent configuration. In some aspects, the track further includes a first indicator marked on the upper portion of each of the first and second flanges, the first indicator vertically aligned with at least one slit. In some aspects, the track further includes a second indicator marked on the upper portion of each of the first and second flanges, the second indicator vertically aligned with a second slit having a first end adjacent to the free ends of the first and second flanges and a second end opposite the first end, the second indicator spaced 8 inches apart from the first indicator.

In some aspects, the track further includes an opening at the second end of each of the plurality of slits, the opening having a width twice a width of the associated slit. In some aspects, the track further includes at least one fire-retardant material strip attached to the track such that the at least one fire-retardant material strip extends lengthwise along a surface of the track. In some aspects, the fire-retardant material strip extends along one or both of the first and second side edges of the web of the track. In some aspects, corners of a free end of the tabs are rounded. In some aspects, the track further includes a compressible foam strip adhesively applied lengthwise along the web of the track.

In another aspect, a wall assembly for a fire-rated or non-fire rated wall having a linear wall gap includes a footer track; a header track comprising a web, a first flange and a second flange, wherein the web is substantially planar and has a first side edge and a second side edge, the first flange and the second flange extend in the same direction from the first and second side edges, respectively, wherein each of the first and second flanges is substantially planar such that the header track defines a substantially U-shaped cross section, each of the first and second flanges has a free end opposite a respective one of the first side edge and second side edge, each of the first and second flanges has at least one slit, the slit having a first end adjacent to the free ends of the first and second flanges and a second end opposite the first end, the slit forming at least two tabs adjacent the free ends of the first and second flanges, the header track having at least one fire-retardant material strip attached thereto such that the at least one fire-retardant material strip extends lengthwise along a surface of the header track; a plurality of studs extending between the footer track and the header track; and at least a first wall board supported by the plurality of studs; wherein the header track is attached to an overhead structure and the bottom track, wall studs and wall board is movable relative to the header track, and wherein each of the at least two tabs are bent inwardly to capture one of the plurality of studs therebetween.

In some aspects, the footer track comprises a web, a first flange and a second flange, wherein the web is substantially planar and has a first side edge and a second side edge, the first flange and the second flange extend in the same direction from the first and second side edges, respectively, wherein each of the first and second flanges is substantially planar such that the footer track defines a substantially U-shaped cross section, each of the first and second flanges has a free end opposite a respective one of the first side edge and second side edge, each of the first and second flanges has at least one slit, the slit having a first end adjacent to the free ends of the first and second flanges and a second end opposite the first end, the slit forming at least two tabs adjacent the free ends of the first and second flanges.

In some aspects, prior to use, the tabs are aligned with the first and second flanges of the header track. In some aspects, the header track has at least one fire-retardant material strip attached thereto such that the at least one fire-retardant material strip extends lengthwise along a surface of the header track. In some aspects, the at least one fire-retardant material strip is an intumescent tape.

In yet another aspect, a method of assembling a fire-rated wall having a linear wall gap is disclosed. The method includes attaching a footer track to a horizontal floor element; attaching a header track to a horizontal ceiling element, the header track comprising a web, a first flange and a second flange, wherein the web is substantially planar and has a first side edge and a second side edge, the first flange and the second flange extend in the same direction from the first and second side edges, respectively, wherein each of the first and second flanges is substantially planar such that the header track defines a substantially U-shaped cross section, each of the first and second flanges has a free end opposite a respective one of the first side edge and second side edge, each of the first and second flanges has at least one slit, the slit having a first end adjacent to the free ends of the first and second flanges and a second end opposite the first end, the slit forming at least two tabs adjacent the free ends of the first and second flanges, the header track having at least one heat-expandable intumescent strip attached thereto such that the at least one heat-expandable intumescent strip extends lengthwise along a surface of the header track; positioning a plurality of studs between the footer track and the header track; bending at least one of the plurality of tabs towards each of the plurality of studs until the tab contacts and grips the stud; and attaching at least one piece of wallboard to the plurality of studs.

BRIEF DESCRIPTION OF THE DRAWINGS

Certain features, aspects and advantages of the various devices, systems and methods presented herein are described with reference to drawings of certain embodiments, which are intended to illustrate, but not to limit, such devices, systems, and methods. It is to be understood that the drawings are for the purpose of illustrating concepts of the embodiments discussed herein and may not be to scale. For example, certain gaps or spaces between components illustrated herein may be exaggerated to assist in the understanding of the embodiments. Dimensions, if provided in the specification, are merely for the purpose of example in the context of the specific arrangements shown and are not intended to limit the disclosure.

DETAILED DESCRIPTION OF THE PREFERRED EMBODIMENTS

Several preferred embodiments provide a way to secure metal studs to the header track or bottom track without using mechanical screw fasteners. The C- or U-shaped header or bottom track includes a plurality of slits in one or both flanges of the track that form a plurality of tabs in the flanges of the track adjacent the free edge of the flanges. The slits extend partially up the legs or flanges of the track so that the bulk of the track is a solid uninterrupted C- or U-shape profile. The track can, in some embodiments, have fire-retardant material such as intumescent strips added to the surface of the back web of the track to provide fire rated wall assemblies according to UL-2079.

Figure 1:
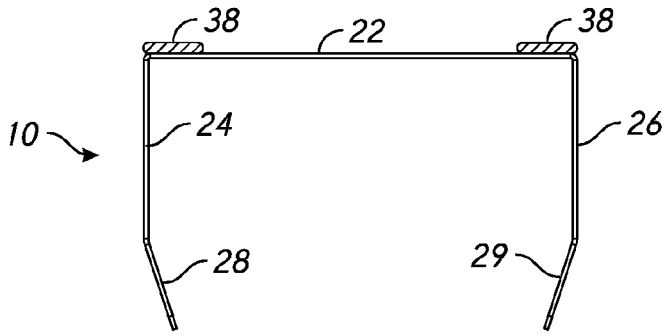
FIG. 1 is a profile illustration of a track that may be used as a header track or a bottom track for wall construction, according to one embodiment.
Figure 2:
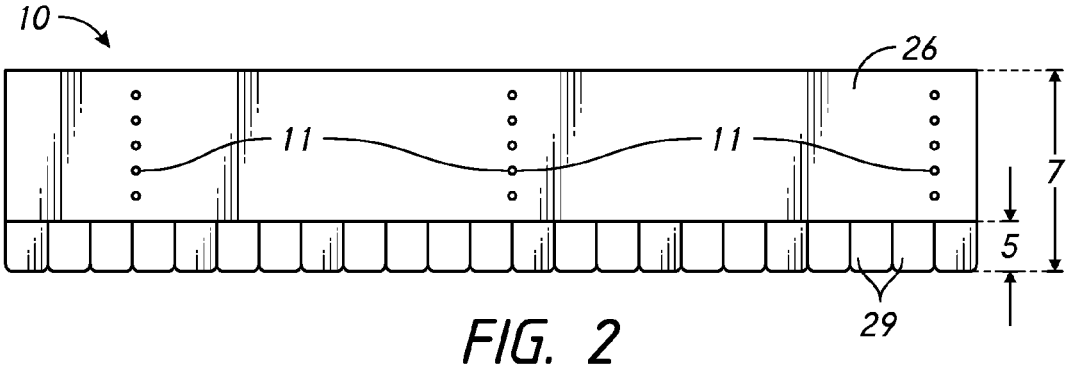
FIG. 2 is a side view illustration of the track of FIG. 1.
Figure 3:
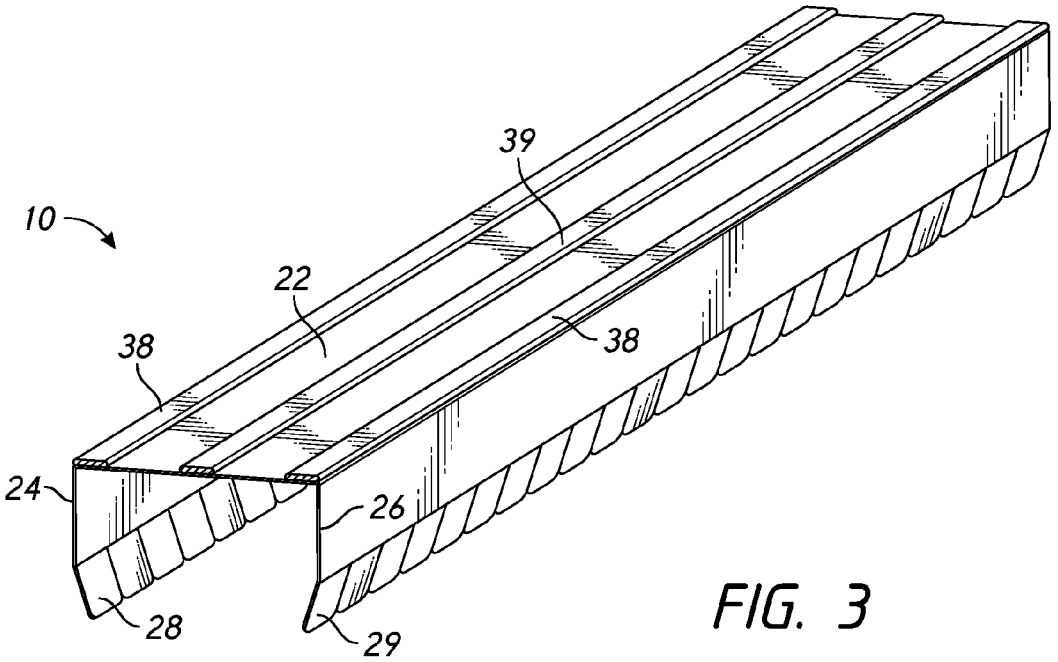
FIG. 3 is a perspective illustration of the track of FIG. 1 with the tabs bent inward.

Referring to FIGS. 1-3, a first embodiment of a track 10 comprises a web 22 and two side flanges 24, 26. A lower end of each of the side flanges 24, 26 comprises a plurality of tabs 28, 29 that may be folded or bent inward towards the web 22 to secure a metal stud, as discussed in greater detail below. Preferably, the side flanges 24, 26 form an interior angle with the web 22 of approximately 89 degrees. In other embodiments, the side flanges 24, 26 form an interior angle with the web of between approximately 70 and 100 degrees, between approximately 80 and 90 degrees, or between approximately 85 and 90 degrees. In some embodiments, as shown in FIG. 2, a height or width 5 of the tabs 28, 29 may be approximately ½ inch and a total height or width 7 of the flanges 24, 26 may be approximately 2 inches, resulting in a height or width of the flanges 24, 26 between the web 22 and the top of the tabs 28, 29 of approximately 1-½ inch, which can be solid in some cases to inhibit or prevent the passage of smoke, sound, light or air between the track 10 and the upper end portion of the wallboard (not shown). As shown in FIG. 1, the tabs 28, 29 may be bent inward toward the web 22 such that a tab displacement 9 is approximately ¼ inch. In some embodiments, the tabs 28, 29 are approximately ⅝ inch on center with 1/16 inch wide slits separating each tab, as discussed in greater detail below.

As further illustrated in FIG. 2, in some embodiments, a vertical indicator 11 may be marked on the flanges 24, 26 with an inkjet printing method or other method. The indicators 11 may be placed every 8 inch on center to indicate placement of the metal stud. In some embodiments, the vertical indicator 11 may be punched into the surface of the flanges 24, 26 with a rotary die, which may create an indentation or a through-hole.

With reference to FIGS. 1 and 3, in some embodiments, one or more pieces or strips of a fire-retardant material 38 may be placed on the exterior surface of the web 22 adjacent to the corners between the web 22 and the flanges 24, 26. The fire-retardant material 38 preferably extends lengthwise along and is attached to the web of the track, but could be attached to the flanges 24, 26 in addition or in the alternative. In use, the fire-retardant material 38 can act in helping to prevent fire, smoke, or other debris from moving past the track 10. Preferably, the fire-retardant material 38 is an intumescent material strip, such as an adhesive intumescent tape. The fire-retardant material 38 is made with a material that expands in response to elevated heat or fire to create a fire-blocking char. One suitable material is marketed as BlazeSeal™ from Rectorseal of Houston, Tex. Other suitable intumescent materials are available from Hilti Corporation, Specified Technologies, Inc., or Grace Construction Products. The intumescent material expands to many times (e.g., up to 35 times or more) its original size when exposed to sufficient heat (e.g., 350 degrees Fahrenheit). Thus, intumescent materials are used as a fire block because the expanding material tends to fill gaps. Once expanded, the intumescent material is resistant to smoke, heat and fire and inhibits fire from passing through the head-of-wall. It is understood that the term fire-retardant material 38 is used for convenience and that the term is to be interpreted to cover other expandable fire-resistant materials as well, such as intumescent paints (e.g., spray-on) or fire-rated dry mix products, unless otherwise indicated. The fire-retardant material 38 can have any suitable thickness that provides a sufficient volume of intumescent material to create an effective fire block, while having small enough dimensions to be accommodated in a wall assembly. That is, preferably, the fire-retardant materials 38 do not cause unsightly protrusions or humps in the wall from excessive build-up of material. In one arrangement, the thickness of the fire-retardant material 38 is between about 1/16 (0.0625) inches and ⅛ (0.125) inches, or between about 0.065 inches and 0.090 inches. One preferred thickness is about 0.075 inches.

The track 10 can be constructed of any suitable material by any suitable manufacturing process. For example, the track 10 can be constructed from a rigid, deformable sheet of material, such as a galvanized light-gauge steel. However, other suitable materials can also be used. The track 10 can be formed by a roll-forming process. However, other suitable processes, such as bending (e.g., with a press brake machine), can also be used. Preferably, the fire-retardant material(s) 38 are applied during the manufacturing process. However, in some applications, the fire-retardant material(s) 38 could be applied after manufacturing (e.g., at the worksite).

Figure 4:
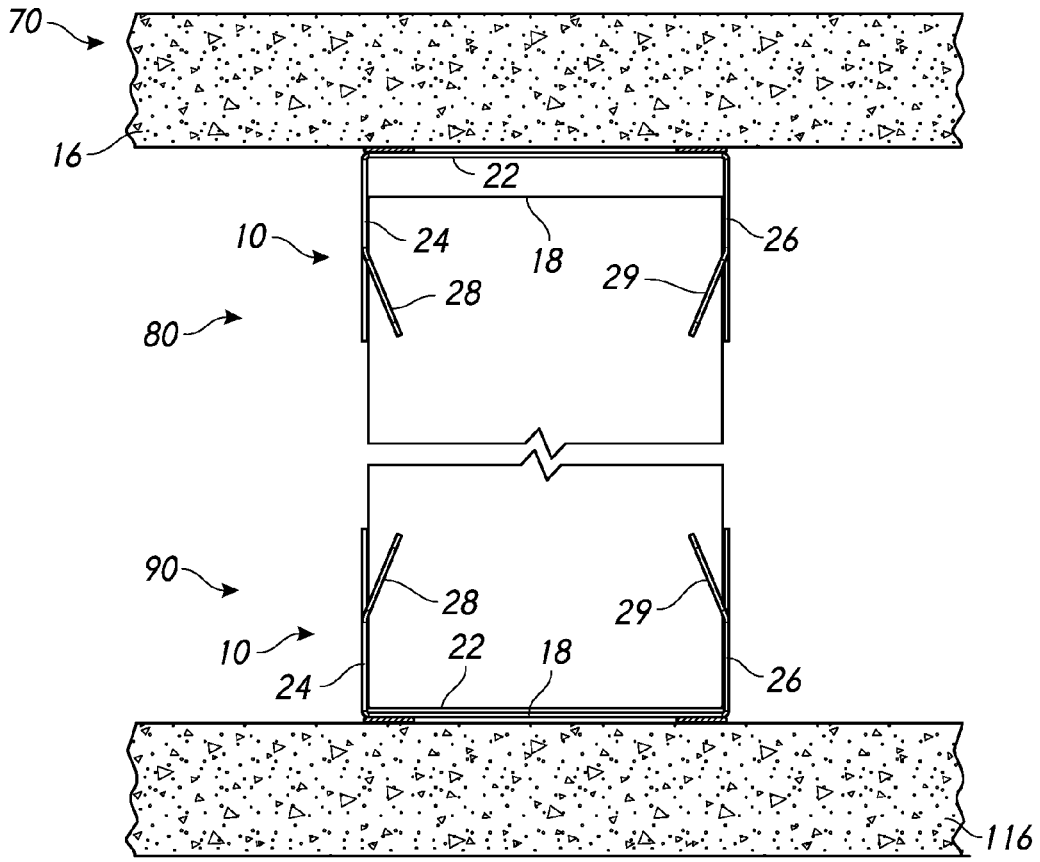
FIG. 4 is an illustration of a head-of-wall and bottom-of-wall assembly incorporating the track of FIG. 1.

FIG. 4 illustrates a wall assembly 70 illustrating a head-of-wall assembly 80 and a bottom-of-wall assembly 90 with each assembly incorporating a track 10. In the head-of-wall assembly 80, the track 10 is a header track attached to a ceiling surface 16 which may be a concrete ceiling. One or more of the tabs 28, 29 are bent inward or remain bent inward, depending on the initial position of the tab, to secure the metal stud 18 near the ceiling. Preferably, a tab 28, 29 on each side of the stud 18 in the length direction of the wall is bent inwardly to secure the stud 18 in place. Similarly, the bottom-of-wall assembly 90 also incorporates a track 10, used as a bottom track that is secured to a floor component 116. One or more of the tabs 28, 29 are bent inward or remain bent inward, depending on the initial position of the tab, to secure the metal stud 18 at the floor. Preferably, a tab 28, 29 on each side of the stud 18 in the length direction of the wall is bent inwardly to secure the stud 18 in place. Use of the track 10 as both a header track and a bottom track provides a convenient way to secure a metal stud in a wall assembly without the use of metal fasteners, such as framing screws. Once the studs 18 are nested into the track 10, the tabs 28, 29 can be pushed inward on either side of the stud 18 and from either side of the wall assembly which will prevent the stud 18 from moving back and forth or side to side. Traditional stud layout is typically 16 inches or 24 inches on center. The manufactured tabs of the track 10 can provide a traditional 16 inch and 24 inch stud layout but the track 10 also allows any other combination of stud spacing because the tabs 28, 29 are preferably spaced to allow one stud per tab opening. Preferably, the tabs are spaced equally and on center to provide a consistent layout for any stud spacing configuration. The track 10 may also be used for non-standard spacing studs. For example, if a non-standard stud spacing is necessary due to other constraints, slits may be created in the field or at the construction site to form tabs at the location along the flange of the track to secure the stud. Additionally, mechanical fasteners, such as framing screws, may be used to further secure the track to the stud, in addition to the securement provided by the gripping force of the bent tabs on the stud.

Figure 5:
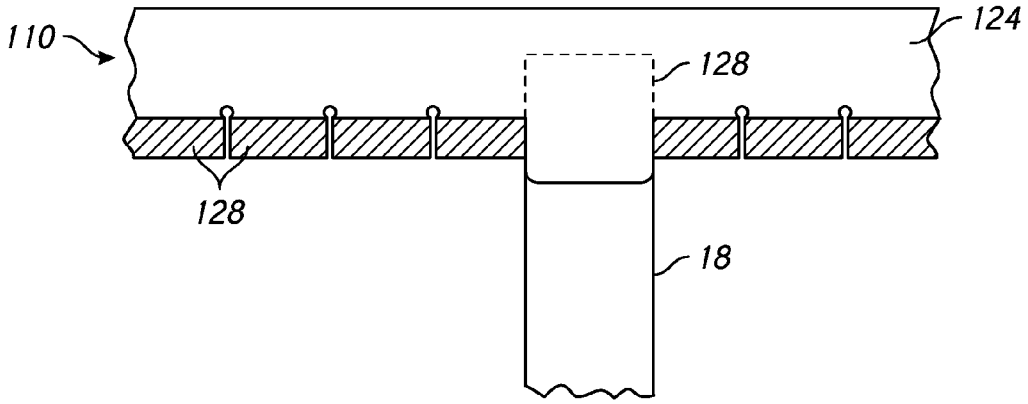
FIG. 5 is a close-up view of a stud held in place with a track, such as the track shown in FIG. 1.

FIGS. 5 illustrates another embodiment of a track with tabs showing the placement of a metal stud within the track. Similar to the track 10 discussed above, the track 110 comprises a web 122 and two side flanges 124, 126. A lower end of each of the side flanges 124, 126 comprises a plurality of tabs 128, 129 that may be folded or bent inward towards the web 122 to secure a metal stud. When the stud 18 is placed within the track 110 such that the flanges 124, 126 are on either side of the stud 18, the tabs 128, 129 may be bent back vertically to receive the stud 18. Once the stud 18 is in place, the tabs 128, 129 may be bent downward vertically to nestle against and securely position the stud 18 within the header track 10. To move the stud 18 to a different location, the tabs 128, 129 can be pulled or rotated away from the stud 18 so that the tabs 128, 129 are even with or extend outward from the flanges 124, 126, releasing the stud 18 and allowing it to be removed.

Figure 6A:
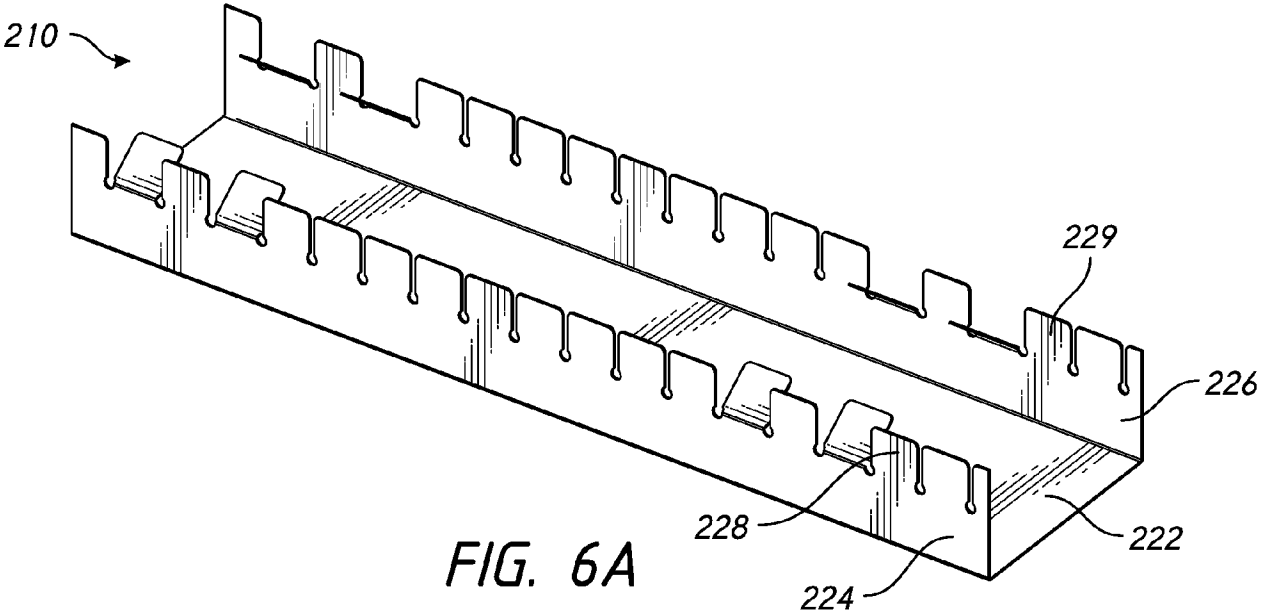
FIG. 6A illustrates another perspective view of the track of FIG. 1.
Figure 6B:
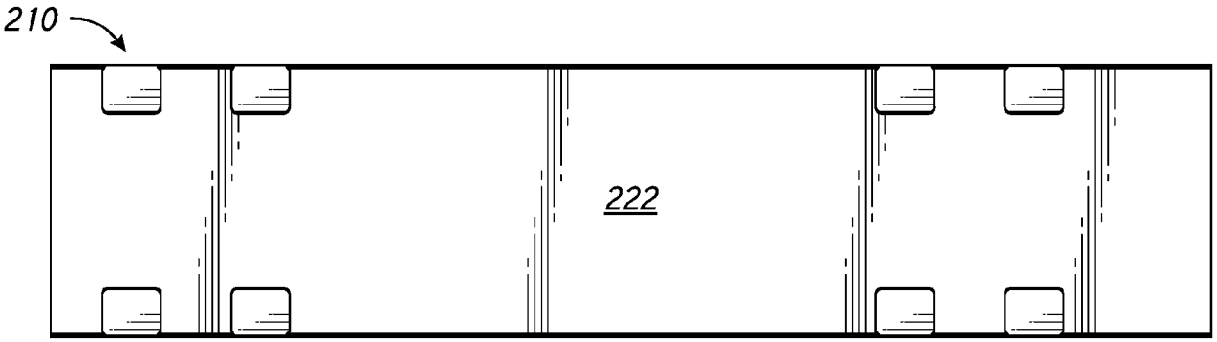
FIG. 6B is an overhead view of the track of FIG. 6A.
Figure 6C:
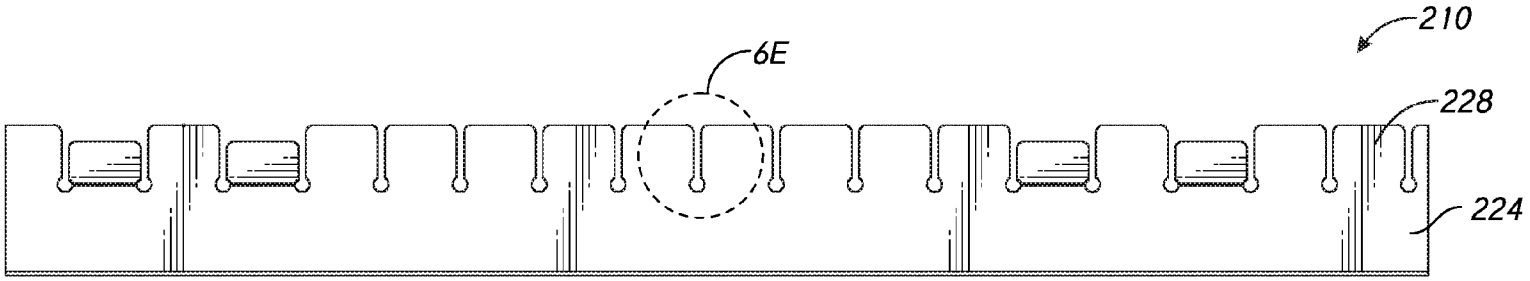
FIG. 6C is a side view of the track of FIG. 6A.
Figure 6E:
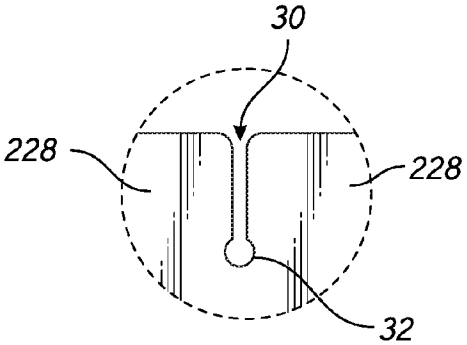
FIG. 6E is a close-up view of one of the slits between the tabs of the track of FIG. 6A.
Figure 6D:
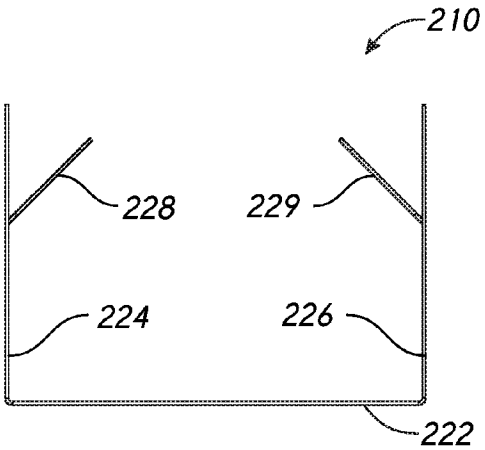
FIG. 6D is a profile view of the track of FIG. 6A.
Figure 7A:
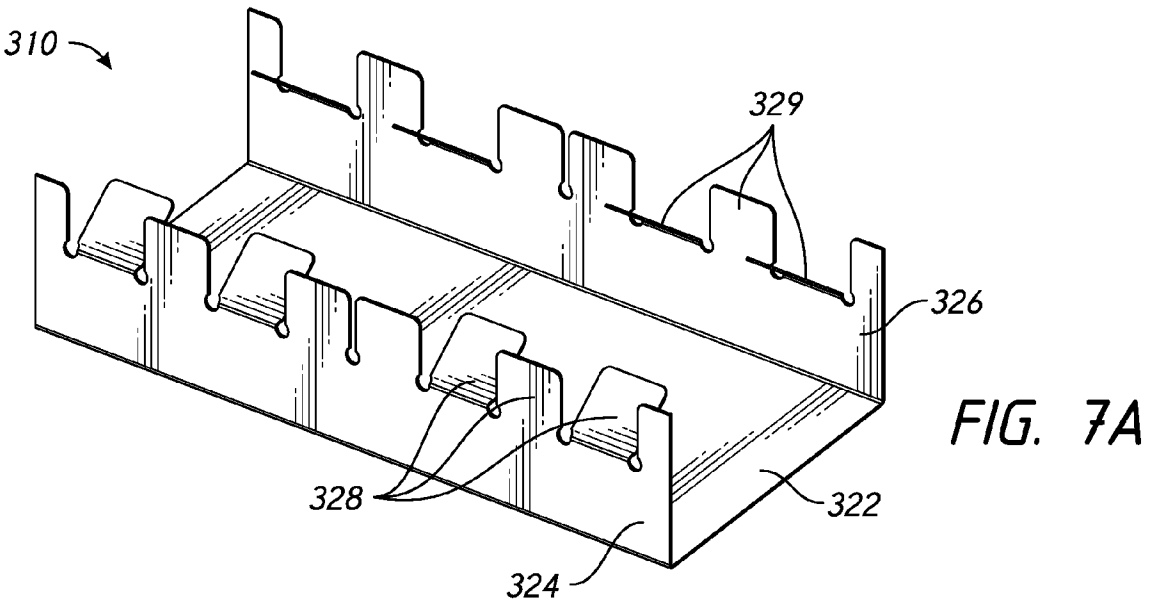
FIG. 7A is a perspective view of a track with some of the tabs bent inwards toward the web of the track.
Figure 7B:
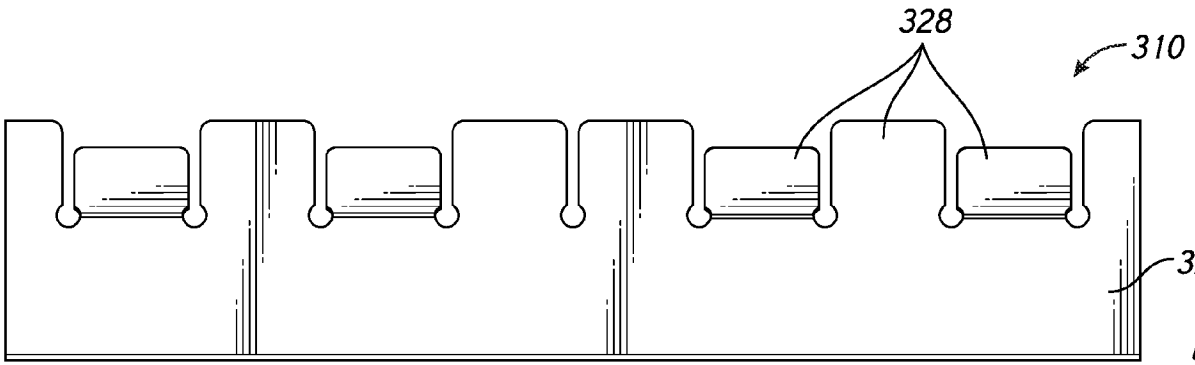
FIG. 7B is a side view of the track of FIG. 7A.
Figure 7C:
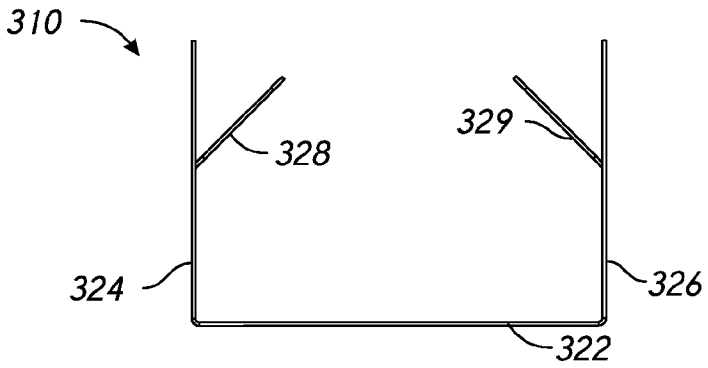
FIG. 7C is a profile view of the track of FIG. 7A.
Figure 7D:
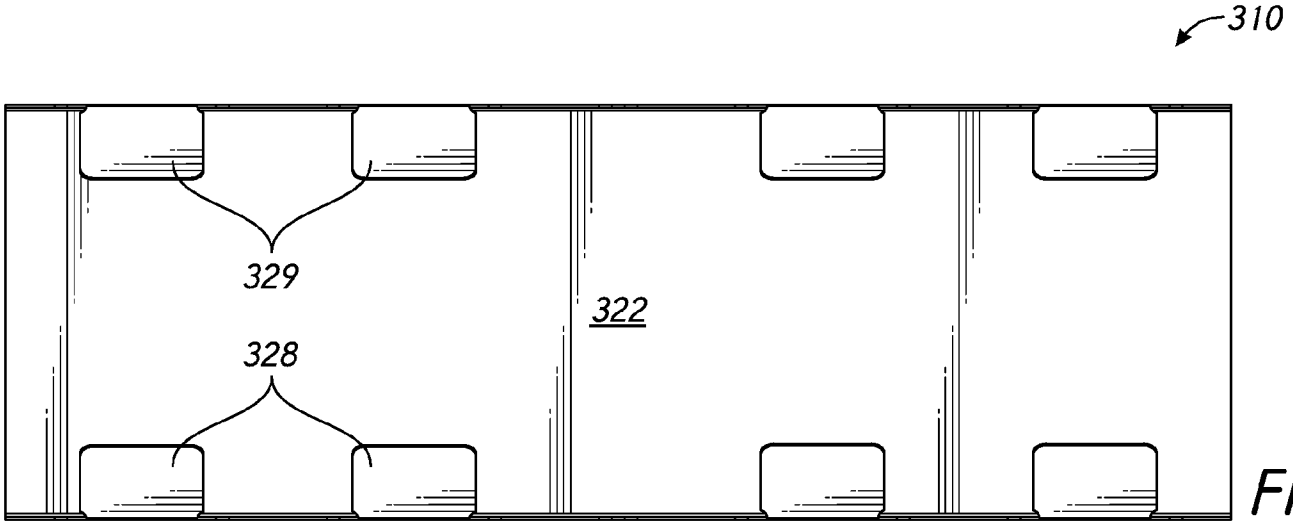
FIG. 7D is an overhead view of the track of FIG. 7A.

FIGS. 6A-6E illustrate another embodiment of a track. The track 210 comprises a web 222 and two side flanges 224, 226. A lower end of each of the side flanges 224, 226 comprises a plurality of tabs 228, 229. The track 210 includes slits and keyholes that form the tabs and allow the tabs to be easily bent to receive and secure a metal stud. As shown in FIG. 6E, in some embodiments, the track 210 has a series of 1/16 inch to 1/8 inch wide slits 30 spaced apart approximately every 1-1/4 inch on center, starting at the open or free end of the flanges 224, 226 and extending vertically partially along the height or width of the flanges 224, 226. One benefit of having the tab spacing wider than the flange width of the stud is that this spacing allows the stud to have the flexibility of moving to the left or the right within the tab spacing. The typical stud flange width is 1-1/4 inch wide. By making the tab spacing 1/8-1/4 inch wider than the stud, the installer could easily shift the stud slightly to the right or left which is useful when the drywall is installed. Preferably, the drywall installer needs the framing studs to align with the center of the vertical drywall board joints so having the ability to move the studs, even just slightly without removing framing fasteners is very beneficial as it saves labor and speeds up the drywall installation.

The slits 30 extend approximately 1/3 of the way up each flange 224, 226 as measured from the free end of the flanges 224, 226. As shown, the slits 30 extend partially along the width or height of the flanges 224, 226 of the track 210 so that the bulk of the track 210 (preferably the upper portion) is a solid uninterrupted U- or C-shaped profile to prevent sound, smoke, or light from passing through the head-of-wall or bottom-of-wall joint. In some embodiments, the slits 30 extend one-third (1/3) of width or height of the flanges 224, 226 as measured from the free end of the flanges. Additionally, the track 210 allows the drywall to be installed tight and flush against the wall framing members because no mechanical fastener is used to attach the stud 18 to the track 210. As illustrated in FIGS. 6A-C, some of the tabs 228, 229 may be bent inward to secure a metal stud while the remainder or unbent tabs 228, 229 continue straight along a plane defined by the flanges 224, 226.

The slits 30 on the track 210 can be made from a rotary die. Use of a rotary die provides consistency to the manufacture of the slits 30. A rotary die can also be used to provide an embossed marking along the flanges 224, 226 of the track 210 for stud layout, as discussed above with respect to the embossed vertical indicators shown in FIG. 2. The embossed markings can be placed every 8 inches on center so that the installer can determine how many embossed markings are between the studs, for accurate stud placement. For example, if the studs are 16 inches on center, there will be one embossed marking on the flanges of the track between the studs and if the studs are 24 inches on center there will be two embossed marked between each stud.

The upper portion of each slit 30 has a round key hole 32 to enable the tabs 228, 229 to bend. In some embodiments, a width of the key hole 32 is up to or equal to twice the width of the slit 30. The key hole 32 provides flexibility to allow the tabs 228, 229 to move inward and outward easily without distorting the profile or leg of the track 10. Additionally, a round key hole 32 allows the flange 224, 226 to remain flat when the tabs 228, 229 are pushed in to secure a stud. While a round key hole 32 is illustrated in FIGS. 6A-6E, any other shape of key hole, such as a square, may be used.

Preferably, in some embodiments, as shown in FIGS. 6A-E, the free ends of the tabs 228, 229 can have rounded corners to allow the studs to be easily engaged and gripped or locked into place. Tabs having sharp, 90 degree corners have sharp edges that could potentially get stuck on the stud and create difficulty engaging the stud. When the tabs 228, 229 are pushed inward on either side of the stud 18, the tabs create a pocket to grip the stud 18 on both sides of the stud 18. This pocket prevents lateral movement but it does not restrict the necessary or required vertical deflection movement, if any.

As discussed above, the track provides a series of pre-bent tabs that provide flexibility and allow the vertical studs numerous locations to lock in place in the track and prevent lateral side to side movement of the stud. To move the stud to a different location, the installer can rotate the stud a half turn which will release the stud out of the restrictions of the tabs. Alternatively, the installer can bend the tabs downward, upward and/or outward to free up the stud. In some embodiments, track can be manufactured with the tabs straight and not pre-bent. When the tabs are not pre-bent, the vertical studs can still be placed anywhere within the series of tabs of the track; however, in this configuration, to engage the stud, the tabs are physically bent by hand or tapped with a hammer on each side of the stud to bend the tabs inward to grip or hold the stud in place and prevent side to side lateral movement of the stud. Pre-bending the tabs during manufacture of the track allows the installer to place and lock-in the studs within the framed wall assembly on layout from the ground and preferably does not require the installer to use a bench or scaffolding to access the top of the wall header track in order to physically push in the tabs on either side of the stud or to mechanically fasten the track to the stud. Any of the embodiments disclosed herein can have pre-bent or straight tabs, or a combination of the two.

Another embodiment of a track with tabs is illustrated in FIGS. 7A-D. The track 310 comprises a web 322 and two side flanges 324, 326. A lower end of each of the side flanges 324, 326 comprises a plurality of tabs 328, 329 that may be folded or bent inward towards the web 322 to secure a metal stud, as discussed above. In these figures, the tabs 328, 329 are shown both bent inward to secure a stud and in a straight position in line with the flanges 324, 326.

Figure 8:
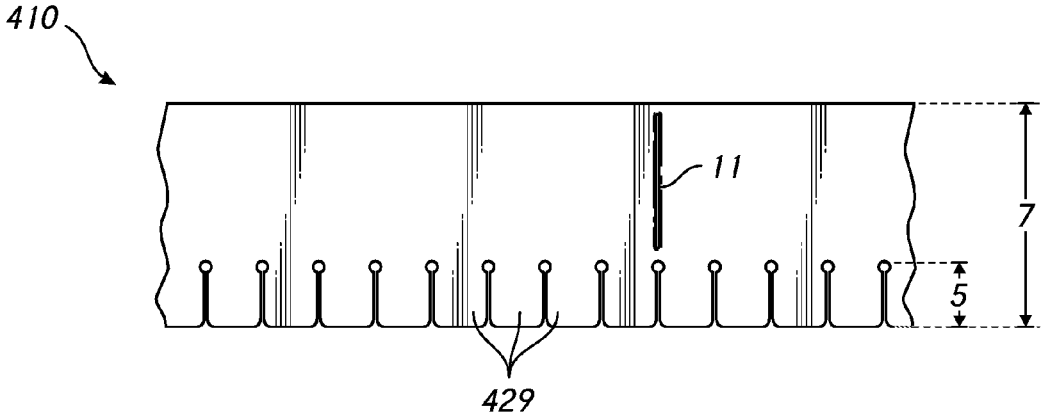
FIG. 8 is a side view of another embodiment of a track having a plurality of tabs.
Figure 9:
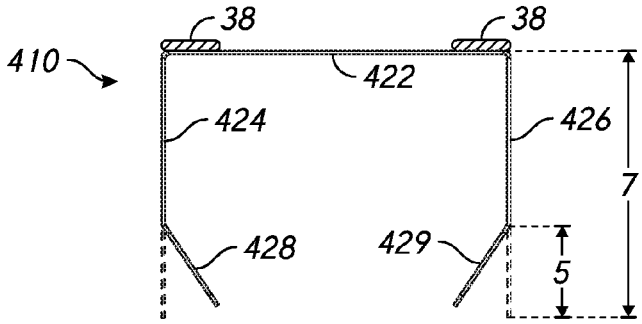
FIG. 9 is a profile view of the track shown in FIG. 8.
Figure 10:
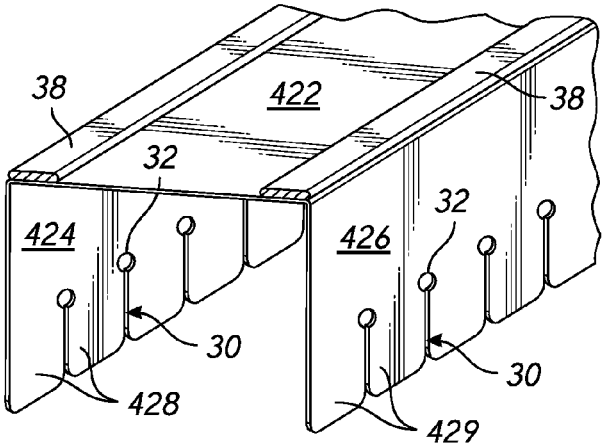
FIG. 10 is a perspective view of the track shown in FIG. 8.

Another embodiment of a track with tabs is illustrated in FIGS. 8-10. The track 410 comprises a web 422 and two side flanges 424, 426. A lower end of each of the side flanges 424, 426 comprises a plurality of tabs 428, 429 that may be folded or bent inward towards the web 422 to secure a metal stud, as discussed above. In these figures, the tabs 428, 429 are shown in a straight position in line with the flanges 424, 426. Slits 30 separate each of the tabs 428, 429 and key holes 32 allow the tabs 428, 429 to be more easily bent to secure and release a stud, as discussed in greater detail above with respect to FIG. 6E. In some embodiments, as shown in FIGS. 8 and 9, a height or width 5 of the tabs 428, 429 may be approximately ¾ inch and a total height or width 7 of the flanges 424, 426 may be approximately 2 inches, resulting in a height or width of the flanges 424, 426 between the web 422 and the top of the tabs 428, 429 of approximately 1-¼ inch. In some embodiments, the tabs 428, 429 are approximately ⅝ inch on center with 1/16 inch wide slits 30 separating each tab, as discussed in greater detail above.

Tenant Improvement or TI construction is typically used in office build outs. Light gauge steel framing is very common in TI construction. In this type of construction, the steel header track is typically attached directly to the underside of the t-bar ceiling. T-bar ceilings are allowed to float as they are attached with wire hangers to the floor structure above. Floating ceilings need to maintain their flexibility throughout the ceiling so direct attachment of the wall studs and track to a floating ceiling will only make the ceiling and wall more rigid. The more rigid the wall, the more likely sound will pass through the wall. Therefore, it is desirable to have a flexible wall connect to a floating ceiling so that both the wall and the ceiling can maintain their flexibility. The embodiments of the track discussed above provide that flexibility because the studs are only gripped into place by the tabs of the track and are not hard-attached to the track (e.g., by mechanical fasteners). This allows the track the flexibility to move up and down with the ceiling. In order to provide additional sound protection, an adhesively-backed foam tape 39 such as 3M SC URETHANE FOAM TAPE can be factory taped to the track (as shown in FIG. 3) so that when the track is installed against the ceiling it will decouple the steel track from the ceiling and create a compressible gasket seal to prevent sound flanking at the head-of-wall joint. The foam tape 39 preferably extends lengthwise along the web and may be applied to either of the edges of the web of the track or may be applied to the center of the web or at any point along with the width of the web.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present fire-block device, system and method has been described in the context of particularly preferred embodiments, the skilled artisan will appreciate, in view of the present disclosure, that certain advantages, features and aspects of the device, system and method may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Any dimensions disclosed herein or included in the accompanying drawings are by way of example only unless specifically claimed. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A track for a wall assembly for a linear wall gap, the track comprising a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section, each of the first and second flanges has a free end opposite a respective one of the first side edge and second side edge, each of the first and second flanges has a plurality of slits, each of the slits having a first end adjacent to the free ends of the first and second flanges and a second end opposite the first end, the plurality of slits defining a plurality of tabs in which each adjacent pair of the plurality of slits forms a tab therebetween, wherein a length of each of the slits is 1 inch, a width of each of the slits is ⅛ inch, and the tabs are spaced apart 1-¼ inch on center along the length of track.

2. The track of claim 1, wherein the tabs extend one-third of the length of the first and second flanges as measured from the free ends of the first and second flanges.

3. The track of claim 1, wherein, prior to use, the tabs are aligned with the first and second flanges.

4. The track of claim 1, wherein the tabs are bendable from a bent to an unbent configuration and from an unbent to a bent configuration.

5. The track of claim 1 further comprising an opening at the second end of each of the plurality of slits, the opening having a width twice a width of the associated slit.

6. The track of claim 1 further comprising at least one fire-retardant material strip attached to the track such that the at least one fire-retardant material strip extends lengthwise along a surface of the track.

7. The track of claim 6, wherein the fire-retardant material strip extends along one or both of the first and second side edges of the web of the track.

8. The track of claim 1, wherein corners of a free end of the tabs are rounded.

9. The track of claim 1 further comprising a compressible foam strip adhesively applied lengthwise along the web of the track.

10. A track for a wall assembly for a linear wall gap, the track comprising a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section, each of the first and second flanges has a free end opposite a respective one of the first side edge and second side edge, each of the first and second flanges has a plurality of slits, each of the slits having a first end adjacent to the free ends of the first and second flanges and a second end opposite the first end, the plurality of slits defining a plurality of tabs in which each adjacent pair of the plurality of slits forms a tab therebetween, the track further comprising a first indicator marked on the upper portion of each of the first and second flanges, the first indicator vertically aligned with at least one slit.

11. The track of claim 10, further comprising a second indicator marked on the upper portion of each of the first and second flanges, the second indicator vertically aligned with a second slit having a first end adjacent to the free ends of the first and second flanges and a second end opposite the first end, the second indicator spaced 8 inches apart from the first indicator.

12. A track for a wall assembly for a linear wall gap, the track comprising a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section, each of the first and second flanges has a free end opposite a respective one of the first side edge and second side edge, each of the first and second flanges has a plurality of slits, each of the slits having a first end adjacent to the free ends of the first and second flanges and a second end opposite the first end, the plurality of slits defining a plurality of tabs in which each adjacent pair of the plurality of slits forms a tab therebetween, wherein a length of each of the slits is 1 inch, a width of each of the slits is 1/16 inch, and the slits are spaced apart every ⅝ to 1-½ inch on center along the length of track.

13. The track of claim 12, wherein the slits are spaced apart every 1-⅜ inch on center along the length of track.

* * * * *